United States Patent [19]

Fierst Van Wijnandsbergen

[11] 3,956,607

[45] May 11, 1976

[54] ELECTRIC CONTACT DEVICE

[75] Inventor: Marius Frederik Fierst Van Wijnandsbergen, Breukelen, Netherlands

[73] Assignee: COQ B.V., Utrecht, Netherlands

[22] Filed: Apr. 18, 1974

[21] Appl. No.: 462,095

[30] Foreign Application Priority Data

May 3, 1973 Netherlands ..... 7306193

[52] U.S. Cl. ..... 200/260; 339/256 RT; 339/262 R

[51] Int. Cl.[2] ..... H01H 1/50; H01R 11/22

[58] Field of Search ..... 200/11 B, 16 B, 16 E, 200/163, 260; 339/255 RT, 256 RT, 262, 258 A, 258 C, 258 T, 64; 29/630 B

[56] References Cited

UNITED STATES PATENTS

| | | | |
|---|---|---|---|
| 2,180,155 | 11/1939 | Leopold | 200/260 X |
| 2,331,255 | 10/1943 | West | 200/16 E X |
| 2,902,666 | 9/1959 | Novajovsky | 339/258 A |
| 3,614,717 | 10/1971 | Boersma et al. | 339/262 R |
| 3,805,220 | 4/1974 | Silbermann | 339/262 R |

FOREIGN PATENTS OR APPLICATIONS

| | | | |
|---|---|---|---|
| 525,754 | 9/1940 | United Kingdom | 339/262 RR |
| 552,995 | 6/1932 | Germany | 339/262 R |
| 186,526 | 10/1922 | United Kingdom | 339/256 RT |
| 358,788 | 10/1931 | United Kingdom | 339/256 RT |
| 1,540,242 | 4/1970 | Germany | 339/256 RT |

*Primary Examiner*—James R. Scott
*Attorney, Agent, or Firm*—Snyder, Brown & Ramik

[57] ABSTRACT

An electric contact device provided with a composite annular contact member and a contact pin cooperating therewith. This contact member comprises a metal holder with a cavity and contained in the latter a circularly bent stack of V-folded contact plates and a stabilizing ring for said plates. Said ring extends through slots of all contact plates and said slots are formed in the narrower inwards extending parts of the contact plates. Said narrower plate parts are adapted to contact with their free contact edges the contact pin and the outwards extending broader parts of the contact plates are with their free contact edges in permanent contact with the holder.

13 Claims, 1 Drawing Figure

ELECTRIC CONTACT DEVICE

Figure 1:
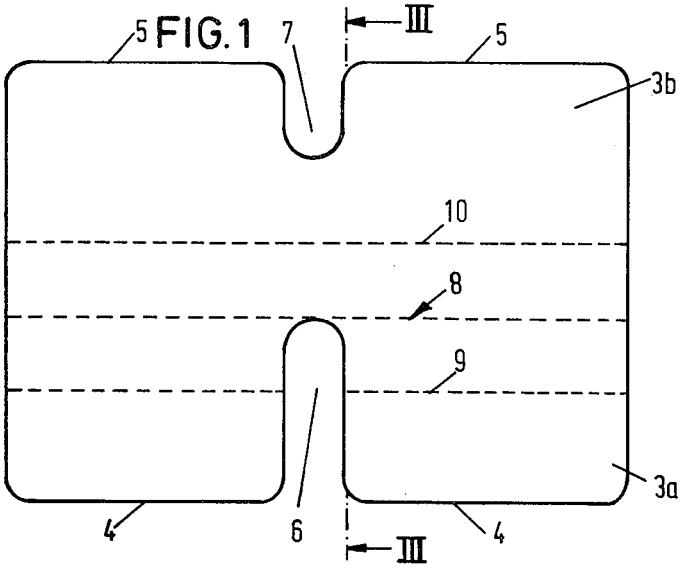

The invention relates to an electric contact device comprising two cooperating contacts which are adapted to be placed into contact with and to be separated from one another, one of said contacts being a contact pin and the other one thereof being a composite annular contact member which surrounds the contact pin, when the device is in its contact making condition, said annular contact member comprising a metal holder having a cavity, which is coaxial to the contact pin and carrying in said cavity an annularly bent stack of interlocking, equal, V-folded, resilient, metal contact plates which are near their folds held in place by a stabilizing ring, of each one of said contact plates one free contact edge which is parallel to the fold being resiliently forced against the contact pin and the other free contact edge which is parallel to the fold being forced against the circumferential wall of the cavity of the holder, when the contact device is in its contact making condition.

An electric contact device of this construction is disclosed by the German Pat. No. 497,734. In this contact device the stabilizing ring has a great number of axial slots, with which the contact plates mesh which have each a slot parallel and adjacent to the fold. Since with a view to the mechanical strength the slots of the stabilizing ring must be spaced apart some millimeters only relatively few contact plates can be mounted in a contact device having a given outer diameter. In order to be able to increase the number of contact plates at given diameters one can only enlarge the diameter of the stabilizing ring. This, however, has the result that the folds of the contact plates come to lie closer to the circumferential wall of the cavity of the holder than to the contact pin, whereby the undisturbed springing of each contact plate in the vicinity of the contact pin is endangered. Furthermore, the slotted ring is an expensive part of the known contact device.

The invention has the object to provide a contact device of the meant kind which is adapted to contain a great number of well resilient contact plates which do not hinder each other, that means a contact device which is suitable for heavy currents and, moreover, can be made and mounted in a cheap way. According to the invention this is achieved, in that of each contact plate the part extendng inwards from its fold has a smaller dimension in the direction at right angles with the fold than the part extending outwards from the fold and includes a slot extending from its contact edge to the fold and containing the stabilizing ring. It has appeared that also, when the contact pin comes to engage the holder with the circular row of contact plates eccentrically, in this construction the stabilizing ring remains substantially concentric to the contact pin as a result of the tough resiliency of the inwards extending narrower parts of the contact plates, so that the contact plates do not force each other away from their places near the contact pin but remain all pressed with their respective contact edges against the contact pin with a resiliency which is mainly determined by the outwards extending broader parts of the contact plates. This has the effect that at all deviations to be expected in practice from the concentric condition of the contact pin and the holder with the contact plates the total contact area between said pin and these plates retains its maximum value.

It is recommended to provide the part of each contact plate extending outwards from the fold thereof in a place opposite the slot containing the stabilizing ring with a slot extending from the contact edge of said part to within some distance from the fold. This has, in the first place, the advantage that, if the contact pin is inserted a little obliquely into the circular row of contact plates, each contact plate is able to twist about its fold, so that it can remain with its entire contact edges in contact with the contact pin and the holder, and in the second place that during the insertion of the row of contact plates into the holder said plates can be temporarily forced on the stabilizing ring and held by means of a bracing wire engaging said second slot. The twisting of the contact plates is easiest and has the greatest effect, if the two slots of each contact plate extend in the plane lying midway between the ends of the fold and directed at right angles with the fold.

A favourable compromise between the resiliency depending on the width of the parts of the contact plates at right angles with the folds thereof and the angle, at which the contact plates contact the contact pin and the holder, is obtained, when the two parts of each contact plate are folded near the fold outwards about lines parallel to the fold. In that case it is possible that those two parts join each other in the fold at an acute angle which is favourable for the resiliency, whereas the angles at which the contact plate contacts the contact pin and the holder are less acute.

Figure 2:
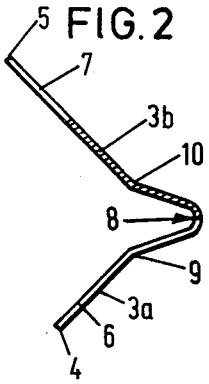
Figure 3:
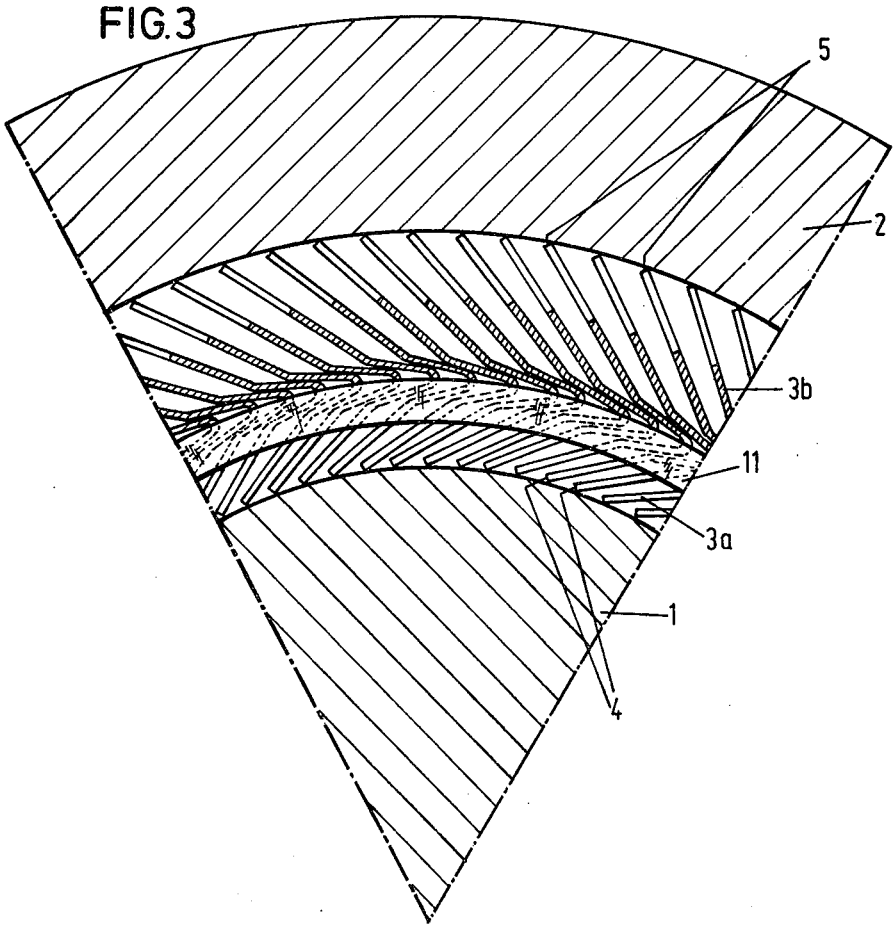

The invention will be further elucidated with the aid of the drawing. Therein is:

FIG. 1 on a larger scale a contact plate for an electric contact device according to the invention in plane condition, FIG. 2 on the same scale a cross sectional view taken along the line III—III of the contact plate shown in FIG. 1 but then in V-folded condition and FIG. 3 on the same large scale a sector of a cross section of a contact device according to the invention and provided with contact plates shown in FIGS. 1 and 2, when the device is in its contact making condition.

In FIG. 3 an axially movable contact pin, e.g. a switching rod of an electric switch or a plug of a plug-and-bushing-connection between separable electric conductors, is designated by 1. This contact pin 1 cooperates with a composite annular contact member which concentrically surrounds said pin in the contact making condition and comprises an annular holder 2 with a cavity which is coaxial to the contact pin 1 and a great number of contact plates 3*a*, 3*b* which are provided in the annular space of said cavity extending between the holder 2 and the contact pin 1. These contact plates, the shape of which in plane condition is shown in FIG. 1, have each midway between their ends two slots 6, 7 directed at right angles with their contact edges 4, 5, of which the slot 6 extends to the dashed line 8 and the slot 7 ends within a given distance from the line 8.

To make the contact plates fit for use they are V-folded about the line 8. In order to improve the contact angle they are folded outwards a little about the lines 9 and 10. The result of the folding operation appears from FIG. 2. A specialty of the contact plates is that they have each a narrow part 3*a* extending from the folding line 8 and a broad part 3*b* extending from said line. It appears from FIG. 3 that the contact plates are each forced with the contact edge of their narrow part 3*a* against the contact pin 1 and with the contact edge 5 of their broad part 3*b* against the circumferential wall of the cavity of the holder 2.

A stabilizing ring 11 is provided in the slot 6 extending throughout the entire narrow part 3*a* of the contact plates (FIG. 3). This ring 11 holds the contact plates 3*a*, 3*b* in place. Owing to the fact that the plates each consist of a narrow part 3*a* directed towards the contact pin 1 and a broad part 3*b* directed towards the holder 2 and the stabilizing ring 11 is entirely situated in the narrow part 3*a*, the stabilizing ring 11 will also practically retain its concentric position about the contact pin 1, when the contact pin 1 is or has been inserted somewhat eccentrically into the holder 2 and the circular row of contact plates 3*a*, 3*b*, so that the eccentricity will be nearly entirely taken up by the slacker resiliency of the broader parts 3*b* of the contact plates. This has the effect that the mutual positions of the narrow parts 3*a* of the contact plates do not change practically, so that these parts will not push each other locally away from the contact pin 1. It is not harmful that, when the position of the contact pin 1 is eccentric, the broad parts 3*b* of the contact plates will have in some places other relative positions than in other places, since also at a so great density of the stack of contact plates that the contact edges 4 facing the contact pin 1 come to lie close together, so that the parts 3*a* will have little room for free movement, these broad parts 3*b* come to lie too wide apart to hinder each other, when their mutual positions shift due to the eccentricity of the contact pin 1.

The wasp waist of the contact plates 3*a*, 3*b* formed by the slots 6, 7 enables the plates to twist a little about said waist. Due thereto the contact edges 4, 5 will be pressed throughout their entire length against the contact pin 1 and the holder 2, also when the contact pin 1 comes to extend with its axis somewhat obliquely in the annular contact member 2, 3*a*, 3*b*, 11.

To assemble the annular contact member 2, 3*a*, 3*b*, 11 first a stack of contact plates 3*a*, 3*b* is formed. Thereafter this stack is bent about the stabilizing ring 11 and almost simultaneously therewith a bracing wire is laid in the slots 7. If this wire is stretched tight the parts 3*b* of the contact plates are forced so far inwards, as to make the outer diameter of the stack of contact plates mounted on the ring 11 a bit smaller than that of the cavity of the holder. The ring 11 with the contact plates 3*a*, 3*b* is then placed into the holder to the region of the slots 6, 7. Thereupon the bracing wire is removed and the ring 11 with the contact plates 3*a*, 3*b* is pushed further into the cavity of the holder.

What I claim is:

1. An electric contact device being provided with two cooperating contacts which are adapted to be placed into contact with and to be separated from one another, one of said contacts being a contact pin and the other one thereof being a composite annular contact member which surrounds the contact pin, when the device is in its contact making condition, said annular contact member comprising a metal holder, a cavity formed in said holder, a circumferential wall of the holder surrounding said cavity, said cavity being coaxial to the contact pin, an annularly bent stack of interlocking, equal, V-folded, resilient, metal contact plates, said stack of contact plates being mounted in the cavity of the holder, free contact edges formed on said contact plates, said contact edges extending parallel to the folds of the V-folded contact plates and being resiliently forced against the contact pin and said circumferential wall of the holder, respectively, when the contact device is in its contact making condition, the dimension of the part of each contact plate extending inwards from the fold of the plate at right angles with said fold being smaller than the corresponding dimension of the part of the plate extending outwards from said fold, a slot formed in the narrower part of each contact plate and extending from the contact edge of said part to the fold of the plate and a stabilizing ring extending through the slots of all contact plates to hold the latter in place in the cavity of the holder.

2. An electric contact device as claimed in claim 1, in which a slot is formed in the outwards extending broader part of each contact plate, said slot extending to within some distance from the fold of the plate and opposite the slot formed in the inwards extending narrower part of the plate and containing the stabilizing ring.

3. An electric contact device as claimed in claim 2, in which the two slots of each contact plate extend in the plane lying midway between the ends of the fold of the contact plate and directed at right angles with said fold.

4. An electric contact device as claimed in claim 1, in which the two parts of each contact plate are folded near the fold of the plate outwards about lines which are parallel to said fold.

5. In an electrical contact device, the combination of:

an annular electrical contact member presenting a cylindrical inner wall surface and a stabilizing ring of a diameter smaller than said inner wall surface, and an annular array of resilient contact plates resiliently seated between said inner wall surface and said stabilizing ring and tending to center said stabilizing ring with respect to said inner wall surface;

each contact plate being of generally V-shape in cross section to define a fold line parallel to said inner wall surface and having an outer edge parallel to said fold line resiliently engaging axially along said inner wall surface to provide good electrical contact therewith, each contact plate also having an inner edge parallel to said fold line and having a slot extending from said inner edge toward said fold line to a point adjacent said fold line to present a bearing surface thereat, said stabilizing ring being received in said slots and seating against the bearing surfaces of said contact plates, those inner portions of the contact plates inwardly of said bearing surfaces to said inner edges being of a first width to position said inner edges inwardly of said stabilizing ring along a circular path centered with respect to said stabilizing ring, and those outer portions of said contact plates which are resiliently flexed between said stabilizing ring and said inner wall surface being of a second width which is greater than said first width whereby an expanding force exerted against said inner edges but off center with respect to said inner wall surface tends likewise to shift said stabilizing ring off center with respect to said inner wall surface.

6. In an electrical contact device as defined in claim 5, a cylindrical contact pin axially shiftable into expanding engagement with said inner edges of the contact plates.

7. In an electrical contact device as defined in claim 5 wherein each contact plate is of generally rectangular configuration and said slot therein extending from midway along its inner edge perpendicularly toward its fold line.

8. In an electrical contact device as defined in claim 7 wherein each contact plate is of gull wing shape to define a pair of further fold lines parallel to and on opposite sides of the fold line first mentioned.

9. In an electrical contact device as defined in claim 8 wherein each contact plate has a further slot extending inwardly from its outer edge toward said fold line first mentioned.

10. An electrical contact device comprising, in combination:

an annular electrical contact member having an inner cylindrical wall of a selected diameter, a stabilizing ring disposed essentially concentrically within said annular member and having an outer surface of a diameter less than said selected diameter whereby to define a first radial spacing between such outer surface of the stabilizing ring and said inner wall of said annular member, and a cylindrical contact pin axially movable to a contact position in which it is disposed substantially concentrically with respect to said stabilizing ring and in spaced opposition to said inner wall of the annular member, said contact pin presenting a cylindrical surface having a selected diameter less than that of said outer surface of said stabilizing ring whereby to define a second radial spacing between said surface of the contact pin and said outer surface of the stabilizing ring, said second radial spacing being less than said first radial spacing; and an annular array of contact plates electrically bridging between said surface of the contact pin and said inner wall of the annular member when said contact pin is in contact position, each contact plate being resilient and having parallel inner and outer edges respectively engaging said surface of the contact pin and said inner wall of the annular member in axially extending relation thereto, each contact plate being generally of V-shape in cross section to define a fold line parallel to said inner and outer edges thereof and said fold line being closer to said inner edge than to said outer edge whereby the outer portion of each plate lying between said fold line and said outer edge is more resilient than the inner portion of the plate which lies between said fold line and said inner edge thereof, each plate having a slot receiving said stabilizing ring and extending from its inner edge to adjacent its fold line whereby each plate seats upon said outer surface of the stablizing ring, the unflexed condition of the outer portion of each plate spacing said outer edge thereof radially from said outer surface of the stabilizing ring by an amount greater than said first radial spacing whereby said annular array of contact plates create hoop compression on said stabilizing ring tending to center it with respect to said inner wall of the annular member, and the unflexed condition of the inner portion of each plate spacing said inner edge thereof radially from said outer surface of the contact ring by an amount greater than said second radial spacing whereby said inner portions of the annular array of contact plates are flexed when said contact pin engages the inner edges thereof so that, due to the greater stiffness of said inner portions of the contact plates, said stabilizing ring will tend to center on said contact pin and shift off center with respect to said annular member if said contact pin is likewise off center with respect to said annular member.

11. An electrical contact device as defined in claim 10 wherein each contact plate is of generally rectangular configuration and said slot therein extending from midway along its inner edge perpendicularly toward its fold line.

12. An electrical contact device as defined in claim 10 wherein each contact plate is of gull wing shape to define a pair of further fold lines parallel to and on opposite sides of the fold line first mentioned.

13. An electrical contact device as defined in claim 10 wherein each contact plate has a further slot extending inwardly from its outer edge toward said fold line first mentioned.

* * * * *